United States Patent [19]

Kato et al.

[11] Patent Number: 4,706,381

[45] Date of Patent: Nov. 17, 1987

[54] MULTI CONTACT CONNECTOR HAVING GROUND TERMINAL BLOCK CONNECTED WITH TAPE WIRES AND METHOD OF CONNECTING TAPE WIRES TO MULTI CONTACT CONNECTOR

[75] Inventors: Matsuo Kato, Utsunomiya; Tomonari Ohtsuki, Mooka; Kazuya Hashimoto, Machida; Masami Nakaide, Odawara, all of Japan

[73] Assignees: Daiichi Denshi Kogyo Kabushiki Kaisha; Hitachi, Ltd., both of Japan

[21] Appl. No.: 864,191

[22] Filed: May 16, 1986

[30] Foreign Application Priority Data

May 23, 1985 [JP] Japan ..... 60-109376

[51] Int. Cl.[4] ..... H01R 11/00

[52] U.S. Cl. ..... 29/857; 439/108

[58] Field of Search ..... 339/14 R, 176 M, 176 F, 339/218 M, 94 M; 29/857, 861, 749

[56] References Cited

U.S. PATENT DOCUMENTS

| | | | |
|---|---|---|---|
| 3,864,011 | 2/1975 | Huber | 339/176 MF X |
| 4,083,615 | 4/1978 | Volinskie | 339/176 MF X |
| 4,105,278 | 8/1978 | Braund et al. | 339/218 M |
| 4,295,696 | 10/1981 | Gray | 339/176 MF X |
| 4,310,208 | 1/1982 | Webster et al. | 339/14 R |
| 4,489,999 | 12/1984 | Miniet | 339/176 MF X |

*Primary Examiner*—Z. R. Bilinsky

*Attorney, Agent, or Firm*—Silverman, Cass, Singer & Winburn, Ltd.

[57] ABSTRACT

A multi contact connector includes a ground terminal block and signal and power source terminals connected with tape wires. Bare wires of the tape wires connected to the signal and power source terminals are provided with roundabout portions respectively to form slacks in the bare wires. With this arrangement, when external tensile forces act upon the connector, the slacks prevent disconnection of bare wires for signal and power source terminals indispensable for operation of the connector, even if a few bare wires among a number of bare wires connected to the ground terminal block are disconnected.

6 Claims, 3 Drawing Figures

MULTI CONTACT CONNECTOR HAVING GROUND TERMINAL BLOCK CONNECTED WITH TAPE WIRES AND METHOD OF CONNECTING TAPE WIRES TO MULTI CONTACT CONNECTOR

BACKGROUND OF THE INVENTION

This invention relates to a multi contact connector having a ground terminal block connected with tape wires and a method of connecting tape wires to a mult contact connector having a ground terminal block.

In electronic instruments such as electronic computers, connectors have been widely used, for example, for connecting printed circuit boards constituting devices to each other and connecting printed circuit boards and external devices.

In this case, for example, as shown in FIG. 1 which is a perspective view illustrating a typical connector of prior art, a printed circuit board 1 is connected to an external circuit by inserting into a receptacle connector 2 connected and fixed to the printed circuit board 1 a plug connector 5 having a ground terminal block 4 and signal and power source terminals 3 respectively corresponding to ground terminals and signal and power source terminals of the board 1. The plug connector 5 is connected through wires to the external circuit. In this case, instead of conventional single wires, flexible tape wires 6 are often used which comprise bare wires 7 corresponding in number and interval to contacts of the connector and coated by an insulator 8 in the form of a tape as shown in FIG. 1.

On the other hand, in connecting the bare wires of the tape-like wires to the signal and power source terminals of the plug connector, the bare wires $7_1$ and $7_2$ which have been cut so as to be positioned on the signal and power source terminals 3 and the ground terminal block 4, respectively, are embraced between welding electrodes to weld these bare wires to the terminals 3 and the block 4 while the wires abut thereagainst as shown in FIG. 1.

Recently, electronic parts have been miniaturized to increase the number of parts on printed circuit boards. The increase of the number of parts requires the miniaturization of connectors and an increase in the number of contacts of the connectors. As the result, width of connecting terminals of connectors and intervals of the terminals have been narrowed limitlessly and diameters of bare wires have become thinner limitlessly. Therefore, as the connectors have been miniaturized and greatly increased their contacts, there is a risk of welding strength being lowered to allow the wires to be disconnected relatively easily by external tensile forces acting upon the tape wires. Moreover, as the diameters of the bare wires have become thinner, the mechanical strength of the bare wires themselves resisting the external tensile forces has decreased. Accordingly, in the event that the partial bare wires are concentrically subjected to external forces, there is a risk of disconnection of the partial bare wires between the insulatingly coated portions and the welded terminals, even if the bare wires in the insulating coating subjected to distributed tensile forces do not disconnect. This risk is relatively slight in the bare wires $7_2$ connected to the ground terminal block 4 but particularly acute in the bare wires $7_1$ connected to the signal and power source terminals and extending from the coated portions to the welded portions. In other words, there is a tendency of the signal and power source wires to be easily disconnected, which are important because disconnection of only one wire causes an obstruction of the operation of the device. On the other hand, the bare wires for the ground terminals are more difficult to disconnect in comparison with the signal and power source wires, in spite that any obstruction of the operation of the device is not caused, even if a few strands for the ground terminals are disconnected.

SUMMARY OF THE INVENTION

It is a principal object of the invention to provide a multi contact connector having a ground terminal block connected with tape wires, which prevents disconnection of bare wires for signal and power source terminals indispensable for the operation of the connector, even if a few bare wires among a number of bare wires connected to the ground terminal block are disconnected.

In order to achieve this object, in a multi contact connector having a ground terminal block and signal and power source terminals connected with tape wires, according to the invention slacks of bare wires of said tape wires connected to the signal and power source terminals are larger than slacks of bare wires of said tape wires connected to the ground terminal block.

In a preferred embodiment, the bare wires of the tape wires connected to the signal and power source terminals are provided with roundabout portions respectively to form the slacks. Each roundabout portion is formed by bending the bare wire at four locations to have a portion substantially parallel to an extending direction of the bare wire and spaced from the ground terminal block.

It is another object of the invention to provide a method of connecting tape wires to a multi contact connector having a ground terminal block and signal and power source terminals, which provides the multi contact connector capable of preventing disconnection of bare wires for the signal and power source terminals.

To this end, a method according to the invention comprises connecting bare wires of the tape wires substantially linearly to the ground terminal block and connecting remaining bare wires of the tape wires to the signal and power source terminals to include slacks in the bare wires.

The invention will be more fully understood by referring to the following detailed specification and claims taken in connection with the appended drawings.

DESCRIPTION OF THE PREFERRED EMBODIMENTS

Figure 2:
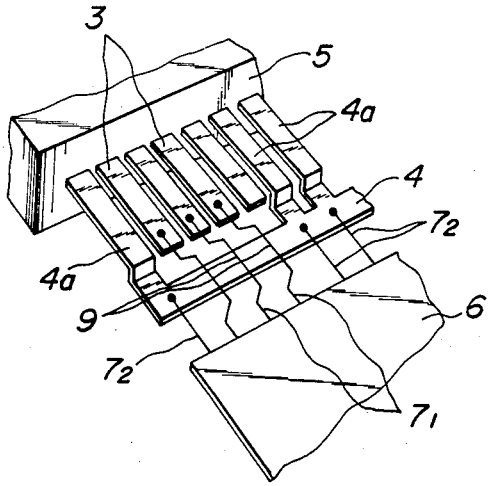
FIG. 2 is a perspective view of one embodiment of a multi contact connector according to the invention.

FIG. 2 is a perspective view illustrating one embodiment of a multi contact connector according to the invention. Bare wires $7_2$ of tape wires 6 to be connected to a ground terminal block 4 are connected thereto substantially linearly in a conventional manner. The ground terminal block 4 is connected to the plug connector 5 by legs 4*a*. Bare wires $7_1$ of the tape wires 6 to be connected to signal and power source terminals 3 are provided with roundabout portions 9 having suitable lengths and heights to form slacks.

In the embodiment shown in FIG. 2, each of the bare wires $7_1$ to be connected to the signal and power source terminal 3 is bent at four locations to have a bare wire portion substantially parallel to an extending direction of the bare wire and spaced from the ground terminal block to form the roundabout portion or the slack.

With this arrangement, when external tensile forces act upon the tape wires 6, the bare wires $7_2$ connected to the ground terminal block 4 and their welded portions will be directly subjected to the external forces, but the bare wires $7_1$ connected to the signal and power source terminals 3 are not directly subjected to the external forces with the aid of the slacks or the roundabout portions 9. Accordingly, even if the partial bare wires $7_2$ connected to the ground terminal block 4 are cut or their welded portions are removed, the bare wires $7_1$ connected to the signal and power source terminals 3 are prevented from being disconnected, thereby eliminating any obstruction of operation of the device.

Figure 1:
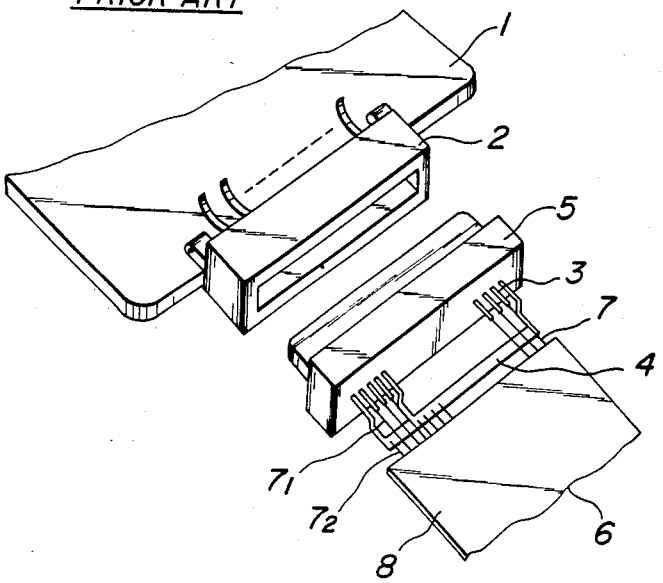
FIG 1 PRIOR ART
FIG. 1 is a perspective view of a multi contact connector of the prior art.
Figure 3:
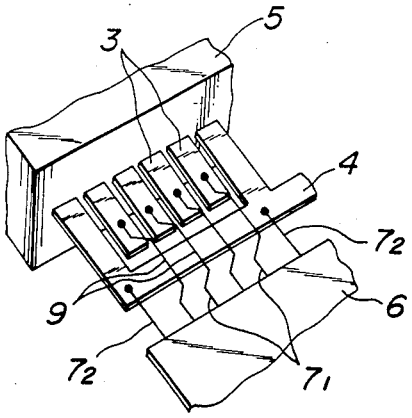
FIG. 3 is a perspective view of another embodiment of a multi contact connector according to the invention.

In the prior art as shown in FIG. 1, the signal and power source terminals 3 are shifted vertically relative to the ground terminal block 4 in order to insulate the bare wires $7_1$ connected to the signal and power source terminals 3 from the ground terminal block 4. By providing the roundabout portions 9 above the ground terminal block according to the invention, the signal and power source terminals 3 can be positioned in flush with the ground terminal block 4. FIG. 3 illustrates such an embodiment.

On the other hand, in case of the signal and power source terminals 3 shifted vertically relative to the ground terminal block 4, the slacks may be formed in wave shapes in respective vertical planes.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A multi contact connector having a ground terminal block and signal and power source terminals to which are connected the terminal ends of bare wires of at least one tape wire, said connections exposed, said bare wires connected to said signal and power source terminals having a greater slack than said bare wires connected to said ground terminal block so that any tensile forces acting upon said tape wire or said ground terminal block are absorbed by said wires connected to said ground terminal block and not by said wires connected to said signal and power source terminals, said bare wires being oriented substantially perpendicular to said ground terminal block.

2. A multi contact connector as set forth in claim 1, wherein the bare wires of said tape wires connected to the signal and power source terminals are provided with roundabout portions respectively to form said slacks.

3. A multi contact connector as set forth in claim 2 wherein each said roundabout portion is formed by bending the bare wire at four locations to have a portion substantially parallel to an extending direction of the bare wire and spaced from the ground terminal block.

4. A multi contact connector as set forth in claim 1, wherein a plane of the signal and power source terminals is located shifted relative to a plane of the ground terminal block.

5. A multi contact connector as set forth in claim 1, wherein a plane of the signal and power source terminals is located substantially in flush with a plane of the ground terminal block.

6. A method of connecting at least one tape wire having a plurality of bare wires to a multi contact connector having a ground terminal block and signal and power source terminals, comprising:

connecting terminal ends of selected bare wires of said tape wire substantially linearly and in substantially perpendicular orientation to said ground terminal block, said selected bare wires having a designated slack; and connecting terminal ends of the remaining bare wires of said tape wire to said signal and power source terminals in substantially perpendicular orientation to said ground bar with a slack, such that the slack of the bare wires connected to the ground terminal block is less than the slack of the bare wires connected to said signal and power source terminals.

* * * * *